US008641021B2

(12) United States Patent
Lundgreen et al.

(10) Patent No.: US 8,641,021 B2
(45) **Date of Patent: *Feb. 4, 2014**

(54) HEAT EXCHANGER FOR REMOVAL OF CONDENSATE FROM A STEAM DISPERSION SYSTEM

(71) Applicant: DRI-STEEM Corporation, Eden Prairie, MN (US)

(72) Inventors: James M. Lundgreen, Lakeville, MN (US); Robert Russell Nelson, Apple Valley, MN (US)

(73) Assignee: DRI-STEEM Corporation, Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/970,717

(22) Filed: Aug. 20, 2013

(65) Prior Publication Data

US 2013/0334717 A1 Dec. 19, 2013

Related U.S. Application Data

(63) Continuation of application No. 11/985,354, filed on Nov. 13, 2007, now Pat. No. 8,534,645.

(51) Int. Cl.
*B01F 3/04* (2006.01)

(52) U.S. Cl.
USPC ..... 261/151; 261/115; 261/DIG. 76

(58) Field of Classification Search
USPC ..... 261/115, 118, 151, DIG. 76
See application file for complete search history.

(56) References Cited

U.S. PATENT DOCUMENTS

| | | | |
|---|---|---|---|
| 903,150 | A | 11/1908 | Braemer |
| 1,101,902 | A | 6/1914 | Braemer |
| 2,963,284 | A | 12/1960 | Bradford |
| 3,096,817 | A | 7/1963 | McKenna |
| 3,215,416 | A | 11/1965 | Liben |
| 3,268,435 | A | 8/1966 | Sellin |
| 3,386,659 | A | 6/1968 | Rea |

(Continued)

FOREIGN PATENT DOCUMENTS

| | | |
|---|---|---|
| DE | 25 29 057 | 2/1977 |
| GB | 1 444 992 | 8/1976 |

(Continued)

OTHER PUBLICATIONS

Wolverine Tube, Inc.—Product Catalog—"Enhanced Surface Tube"—[online]—downloaded Oct. 4, 2007, pp. 1-2, http://www.wlv.com/products/products/Enhanced/enhanced.htm.

(Continued)

*Primary Examiner* — Robert A Hopkins
(74) *Attorney, Agent, or Firm* — Merchant & Gould P.C.

(57) ABSTRACT

A steam dispersion apparatus includes a steam chamber communicating in an open-loop arrangement with a first steam source for supplying steam to the steam chamber. The steam chamber includes a steam dispersion location at which steam exits therefrom at generally atmospheric pressure. A heat exchanger communicates in a closed-loop arrangement with a second steam source for supplying steam to the heat exchanger at a pressure generally higher than atmospheric pressure. The heat exchanger is located at a location that is not directly exposed to the air to be humidified, the heat exchanger being in fluid communication with the steam chamber so as to contact condensate from the steam chamber. The heat exchanger converts condensate formed by the steam chamber back to steam when the condensate contacts the heat exchanger.

15 Claims, 8 Drawing Sheets

(56) References Cited

U.S. PATENT DOCUMENTS

| | | | |
|---|---|---|---|
| 3,443,559 | A | 5/1969 | Pollick |
| 3,486,697 | A | 12/1969 | Fraser |
| 3,623,547 | A | 11/1971 | Wallans |
| 3,635,210 | A | 1/1972 | Morrow |
| 3,642,201 | A | 2/1972 | Potchen |
| 3,696,861 | A | 10/1972 | Webb |
| 3,724,180 | A | 4/1973 | Morton et al. |
| 3,768,290 | A | 10/1973 | Zatell |
| 3,857,514 | A | 12/1974 | Clifton |
| 3,870,484 | A | 3/1975 | Berg |
| 3,923,483 | A | 12/1975 | Hilmer et al. |
| 3,955,909 | A | 5/1976 | Craig et al. |
| 4,040,479 | A | 8/1977 | Campbell et al. |
| RE30,077 | E | 8/1979 | Kun et al. |
| 4,257,389 | A | 3/1981 | Texidor et al. |
| 4,265,840 | A | 5/1981 | Bahler |
| 4,384,873 | A | 5/1983 | Herr |
| D269,808 | S | 7/1983 | Morton |
| 4,438,807 | A | 3/1984 | Mathur et al. |
| 4,660,630 | A | 4/1987 | Cunningham et al. |
| 4,765,058 | A | 8/1988 | Zohler |
| 4,913,856 | A | 4/1990 | Morton |
| 4,967,728 | A | 11/1990 | Dueck |
| 5,054,548 | A | 10/1991 | Zohler |
| 5,126,080 | A | 6/1992 | Morton et al. |
| 5,146,979 | A | 9/1992 | Zohler |
| 5,186,252 | A | 2/1993 | Nishizawa et al. |
| 5,277,849 | A | 1/1994 | Morton et al. |
| 5,333,682 | A | 8/1994 | Liu et al. |
| 5,372,753 | A | 12/1994 | Morton |
| 5,376,312 | A | 12/1994 | Morton et al. |
| 5,516,466 | A | 5/1996 | Schlesch et al. |
| 5,525,268 | A | 6/1996 | Reens |
| 5,543,090 | A | 8/1996 | Morton et al. |
| 5,697,430 | A | 12/1997 | Thors et al. |
| 5,860,279 | A | 1/1999 | Bronicki et al. |
| 5,942,163 | A | 8/1999 | Robinson et al. |
| 5,996,686 | A | 12/1999 | Thors et al. |
| 6,065,740 | A | 5/2000 | Morton |
| 6,092,794 | A | 7/2000 | Reens |
| 6,167,950 | B1 | 1/2001 | Gupte et al. |
| 6,227,526 | B1 | 5/2001 | Morton |
| 6,371,058 | B1 | 4/2002 | Tung |
| 6,378,562 | B1 | 4/2002 | Noone et al. |
| 6,398,196 | B1 | 6/2002 | Light et al. |
| 6,485,537 | B2 | 11/2002 | Brilmaker |
| 6,488,219 | B1 | 12/2002 | Herr |
| 6,631,856 | B2 | 10/2003 | Herr |
| 6,824,127 | B2 | 11/2004 | Park et al. |
| 6,883,597 | B2 | 4/2005 | Thors et al. |
| 7,048,958 | B2 | 5/2006 | de Jong et al. |
| 7,150,100 | B2 | 12/2006 | Tase et al. |
| 7,178,361 | B2 | 2/2007 | Thors et al. |
| 7,254,964 | B2 | 8/2007 | Thors et al. |
| 7,744,068 | B2 | 6/2010 | Lundgreen et al. |
| 2001/0045674 | A1 | 11/2001 | Herr |
| 2002/0089075 | A1 | 7/2002 | Light et al. |
| 2002/0163092 | A1 | 11/2002 | Park et al. |
| 2004/0026539 | A1 | 2/2004 | Herr |
| 2004/0182855 | A1 | 9/2004 | Centanni |
| 2005/0126215 | A1 | 6/2005 | Thors et al. |
| 2005/0212152 | A1 | 9/2005 | Reens |
| 2006/0196449 | A1 | 9/2006 | Mockry et al. |
| 2008/0290533 | A1 | 11/2008 | Dovich et al. |
| 2009/0121367 | A1 | 5/2009 | Lundgreen et al. |
| 2009/0166018 | A1 | 7/2009 | Lundgreen et al. |

FOREIGN PATENT DOCUMENTS

| | | |
|---|---|---|
| GB | 2 019 233 A | 10/1979 |
| WO | WO 00/57112 | 9/2000 |
| WO | WO 2007/099299 A1 | 9/2007 |

OTHER PUBLICATIONS

Wolverine Tube, Inc.—Turbo-ELP—"ID/OD Enhanced Surface for Improved Boiling Heat Transfer"—[online]—downloaded Nov. 13, 2008, pp. 1-3, http://www.wlv.com/products/products/Enhanced/TurboELP.htm.

NORTEC Inc., Web Page, SAM-e—Short Absorption Manifold—Submitted Drawings, Printed May 21, 2007, pp. 1-26.

ZOTEFOAMS Inc., ZOTEK® F—High Performance PVDF Foams (For Buildings and Construction)—"Taking foam technology to a new level," pp. 1-2, Oct. 2009.

ZOTEFOAMS Inc., ZOTEK® F—High Performance PVDF Foams (For Aviation and Aerospace)—"Taking foam technology to a new level," pp. 1-4, Oct. 2009.

ZOTEFOAMS Inc., ZOTEK® F—High Performance PVDF Foams—"Taking foam technology to a new level," pp. 1-4, Oct. 2009.

ZOTEFOAMS Inc., ZOTEK® F—High Performance PVDF Foams (New Light Weight Materials—Inspiration for Design Innovation)—"Taking foam technology to a new level," pp. 1-6, Date Printed: Dec. 23, 2008.

HEAT EXCHANGER FOR REMOVAL OF CONDENSATE FROM A STEAM DISPERSION SYSTEM

CROSS-REFERENCE TO RELATED APPLICATIONS

This application claims benefit of U.S. patent application Ser. No. 11/985,354, filed Nov. 13, 2007, now U.S. Pat. No. 8,534,645, which application is hereby incorporated by reference in its entirety.

TECHNICAL FIELD

The principles disclosed herein relate generally to the field of steam dispersion humidification. More particularly, the disclosure relates to a steam dispersion system that pipes condensate away from the system by transferring the condensate from atmospheric pressure to boiler pressure with the use of a heat exchanger that is in fluid communication with a central steam manifold.

BACKGROUND

In the humidification process, steam is normally discharged from a steam source as a dry gas. As steam mixes with cooler duct air, some condensation takes place in the form of water particles. Within a certain distance, the water particles are absorbed by the air stream within the duct. The distance wherein water particles are completely absorbed by the air stream is called absorption distance. Another term that may be used is a non-wetting distance. This is the distance wherein water particles or droplets no longer form on duct equipment (except high efficiency air filters, e.g.). Past the non-wetting distance, visible wisps of steam (water droplets) may still be visible, for example, saturating high efficiency air filters. However, other structures will not become wet past this distance. Absorption distance is typically longer than the non-wetting distance and occurs when visible wisps have all disappeared and the water vapor passes through high efficiency filters without wetting them. Before the water particles are absorbed into the air within the non-wetting distance and ultimately the absorption distance, the water particles collecting on duct equipment may adversely affect the life of such equipment. Thus, a short non-wetting or absorption distance is desirable.

Steam dispersion systems that utilize a single tube configuration normally have long non-wetting or absorption distances. Steam dispersion systems that utilize designs with a plurality of closely spaced tubes with hundreds of nozzles achieve a short non-wetting or absorption distance. However, such designs may create significant amounts of unwanted condensate. Depending upon the type of steam dispersion system, there have been a number of different methods utilized in the prior art for disposing of unwanted condensate.

In discussing condensate removal, there are two basic types of steam dispersion humidifying systems, one that uses non-jacketed dispersion tubes, herein referred to as a "Steam Dispersion Tube Panel" system, and another that uses a steam jacket wrapped around each dispersion tube, herein referred to as a "Steam Injection" system. Virtually, in all systems, some steam condenses into liquid water as it flows within the humidification system prior to being dispersed into the space requiring humidification. Steam Dispersion Tube Panel systems can be used with either atmospheric pressure steam or pressurized boiler steam. The condensate that forms within a Steam Dispersion Tube Panel system is collected in a manifold (e.g., a header) and may be drained to a P-trap where it is either discharged to a drain via gravity, returned to an atmospheric steam generator via gravity, or collected and pumped back to the atmospheric steam generator or boiler condensate collection point with condensate pumps.

Steam Injection type humidifiers are used with boilers since they employ a steam jacket within which flows boiler steam, normally at about 5 psi to 60 psi. The steam jacket wraps around each dispersion tube and vaporizes condensate forming within the dispersion tube, thus, eliminating the need to drain condensate at atmospheric pressure out of the dispersion tubes. The energy to vaporize the condensate within the dispersion tubes comes from condensing an equivalent mass of steam within the steam jacket. Since the steam jacket is under pressure, the condensate within the steam jacket is returned to the boiler without the restrictions, costs, and the piping complexity imposed by P-traps, proper slopes for draining, installation/maintenance of condensate pumps, and possible confusion involved with various steam piping, some of which may be operating at atmospheric pressure and some of which may be operating at boiler pressure. Some examples of Steam Injection type systems can be found in U.S. Pat. Nos. 3,386,659; 3,642,201; 3,724,180; 3,857,514; 3,923,483; 5,543,090; 5,942,163; 6,227,526; 6,485,537; and Des. 269, 808.

Steam Dispersion Tube Panel systems have less heat gain to the duct air, and, thus, waste less energy, compared to Steam Injection systems, since there are no steam jackets exposed to the air flow. The surface temperatures are also lower than the surface temperatures of the steam jackets. They also have shorter absorption distances since the absence of steam jackets allows the dispersion tubes to be more closely spaced. Given comparable capacities and absorption distances, a Steam Dispersion Tube Panel system will also have less static air pressure drop across the assembly than a Steam Injection system. However, the condensate from Steam Dispersion Tube Panel systems is often wasted to a drain due to the cost and maintenance of using condensate pumps. Additionally, the clearance needed below the bottom of a Steam Dispersion Tube Panel system for a P-trap is often difficult to accommodate, as is the piping exiting the P-trap, which is normally sloped.

Steam Injection systems seldom waste condensate to a drain as the condensate is pressurized and returned to the boiler without the cost and maintenance problems of condensate pumps or the clearance problems of P-traps and sloped drain lines. However, Steam Injection systems have more heat gain, and, thus, waste more energy than Steam Dispersion Tube Panel systems. They also have longer absorption distances and more static air pressure drop than comparable Steam Dispersion Tube Panel systems.

It is desirable for a humidification system that possesses the advantages of both a Steam Dispersion Tube Panel system and a Steam Injection system without any of their associated disadvantages.

SUMMARY

The principles disclosed herein relate to a steam dispersion system that uses boiler pressure or pressurized steam to pipe condensate away from the system and return it to the boiler without the use of pumps.

According to one particular aspect, the disclosure is directed to a steam dispersion system that uses a steam heat exchanger located in fluid communication with a central steam chamber or manifold to pipe condensate away from the system by transferring the condensate from atmospheric pressure to boiler pressure.

According to another particular aspect, the disclosure is directed to a steam dispersion system that uses a higher pressure steam heat exchanger within a low pressure steam header to pipe unwanted condensate away from the system, wherein the steam heat exchanger may form a closed-loop arrangement with a pressurized steam source.

According to another particular aspect, the steam dispersion system of the disclosure includes a steam dispersion apparatus that has a steam chamber communicating in an open-loop arrangement with a steam source for supplying steam to the steam chamber. The steam chamber includes a steam dispersion location at which steam exits from the steam chamber at generally atmospheric pressure. A heat exchanger communicates in a closed-loop arrangement with a pressurized steam source for supplying steam to the heat exchanger at a pressure generally higher than atmospheric pressure. The heat exchanger is located at a location that is in fluid communication with the condensate formed within the steam chamber. The heat exchanger converts condensate formed by the steam chamber back to steam when the condensate contacts the heat exchanger.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
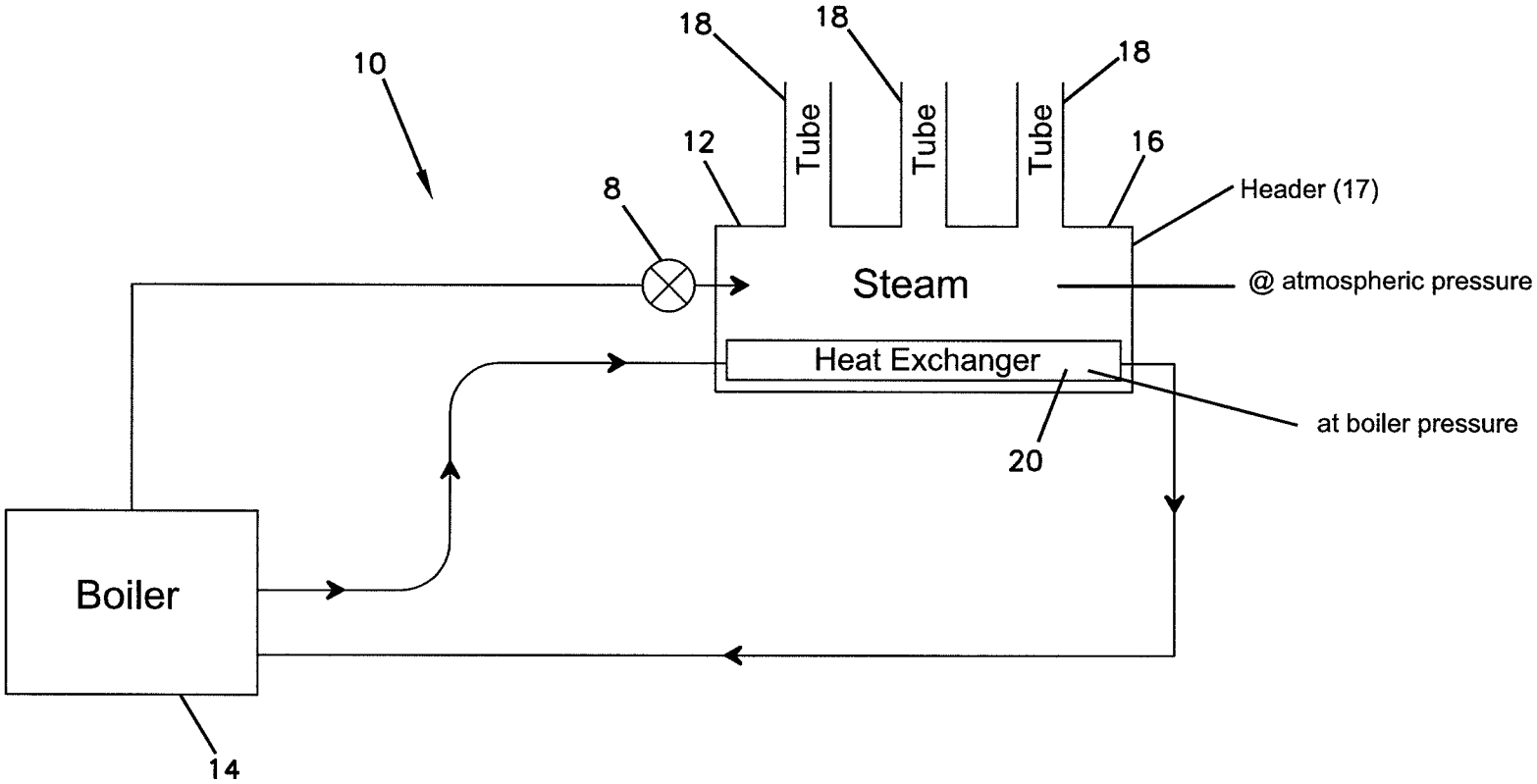
FIG. 1 is a diagrammatic view of a steam dispersion system having features that are examples of inventive aspects in accordance with the principles of the present disclosure.

A steam dispersion system 10 having features that are examples of inventive aspects in accordance with the principles of the present disclosure is illustrated diagrammatically in FIG. 1. The steam dispersion system 10 includes a steam dispersion apparatus 12 and a steam source 14. The steam source 14 may be a boiler or another steam source such as an electric or gas humidifier. The steam source 14 provides pressurized steam towards a manifold 16 of the steam dispersion apparatus 12. In the depicted example, the pressurized steam passes through a modulating valve 8 for reducing the pressure of the steam from the steam source 14 to about atmospheric pressure before it enters the manifold 16. Steam tubes 18 coming out of the manifold 16 disperse the steam to the atmosphere at atmospheric pressure. In the embodiment illustrated in FIG. 1, the manifold 16 is depicted as a header 17, which is a manifold is designed to distribute pressure evenly among the tubes protruding therefrom.

In accordance with the steam dispersion system 10 of FIG. 1, the steam source 14 also supplies steam to a heat exchanger 20 (i.e., evaporator) located within the header 17. The steam supplied to the heat exchanger 20 is piped through a continuous loop with the steam source 14. The steam supplied by the steam source 14 is piped through the system 10 at a pressure generally higher than atmospheric pressure, which is normally the pressure within the header 17. In this manner, pumps or other devices to pipe the steam through the system 10 may be eliminated.

Although illustrated as being the same, it should be noted that the steam source supplying steam to the header 17 and steam to the heat exchanger may be two different steam sources. For example, the source that supplies humidification steam to the header 17 may be generated by a boiler or an electric or gas humidifier which operates under low pressure (e.g., less than 1 psi.). In other embodiments, the source that supplies humidification steam to the header may be operated at higher pressures, such as between about 2 psi and 60 psi. In other embodiments, the humidification steam source may be run at higher than 60 psi. The humidification steam that is inside the header ready to be dispersed is normally at about atmospheric pressure when exposed to air.

The pressure of the heat exchanger steam is normally higher than the pressure of the humidification steam. The heat exchanger steam source may be operated between about 2 psi and 60 psi and is configured to provide steam at a pressure higher than the pressure of the humidification steam that is to be dispersed. The heat exchanger steam source may be operated at pressures higher than 60 psi.

Although in the depicted embodiment, the internal heat exchanger 20 is shown as being utilized within a manifold depicted as a header, it should be noted that the heat exchanger 20 of the system can be used within any type of a central steam chamber that is likely to encounter condensate, either from the dispersion tubes 18 or other parts of the system 10. A header is simply one example of a central steam chamber wherein condensate dripping from the tubes 18 is likely to contact. It should not be used to limit the inventive aspects of the disclosure.

In other embodiments, the heat exchanger may be located at a location other than within a central steam chamber. For example, in another embodiment, the heat exchanger may be located at a location that is remote from the central steam chamber, however, still being in fluid communication with the condensate within the central steam chamber. In this manner, condensate may still be pumped away without the use of pumps or other devices. Please see FIGS. 9 and 10 for an example of such a system.

Figure 2:
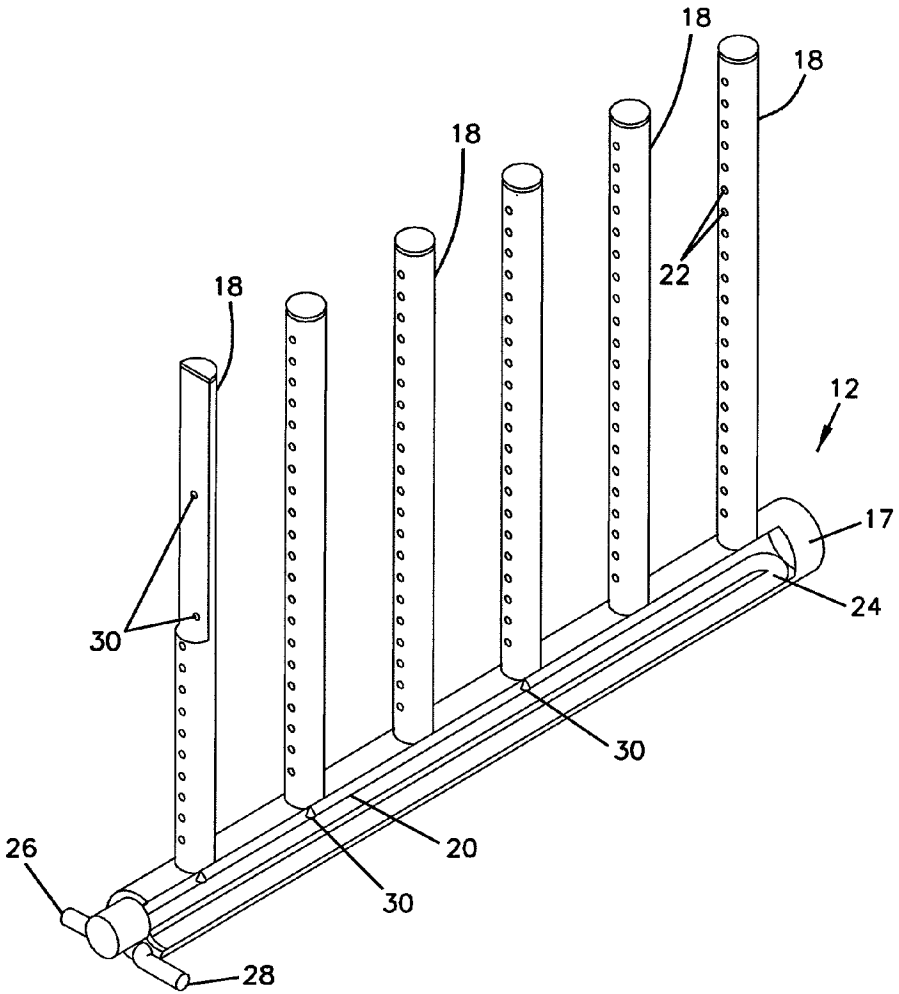
FIG. 2 illustrates a perspective view of a steam dispersion apparatus of the steam dispersion system of FIG. 1, the steam dispersion apparatus having features that are examples of inventive aspects in accordance with the principles of the present disclosure.

FIG. 2 illustrates a perspective view of an embodiment of the steam dispersion apparatus 12 configured for use with the steam dispersion system 10 of FIG. 1. The steam dispersion apparatus 12 includes the plurality of steam dispersion tubes 18 extending from the single header 17. In the embodiment shown, the steam dispersion apparatus 12 includes six steam dispersion tubes 18 extending out of the header 17. The header 17 receives steam from the steam source 14 and the steam is dispersed into air (e.g., duct air) through nozzles 22 of the steam tubes 18. As discussed above, the humidification steam inside the header 17 communicating with the tubes 18 may be at atmospheric pressure, generally at about 0.1 to 0.5 psi and at about 212 degrees F. In other embodiments, the steam inside the header 17 may be at less than 1 psi.

Still referring to FIG. 2, in the embodiment of the dispersion system 10, the steam dispersion apparatus 12 includes the heat exchanger 20 within the header 17. In the depicted embodiment, the heat exchanger 20 is formed from continuous closed-loop piping that communicates with the steam source 14. The portion of the heat exchanger 20 within the header 17 is a U-shaped pipe 24 that generally spans the full length of the header 17. In the depicted embodiment, the steam heat exchanger 20 is generally located at a bottom portion of the header 17. Steam at steam source pressure (e.g., boiler pressure) is supplied to the heat exchanger 20 and enters the heat exchanger 20 via an inlet 26. As discussed above, the steam entering the heat exchanger 20 is generally at about 2-60 psi and at about 220 degrees F. to 310 degrees F. In certain embodiments, the steam provided by the steam source 14 may be at about 15 psi. In certain other embodiments, the steam provided by the steam source 14 may be at about 5 psi. In other embodiments, the steam provided by the steam source 14 may be at no less than about 2 psi. In yet other embodiments, the steam provided by the steam source may be at more than 60 psi. The steam within the heat exchanger 20 is piped therethrough and exits the heat exchanger 20 through an outlet 28.

According to one embodiment, the steam heat exchanger 20 is depicted as a U-shaped pipe 24. It should be noted that other types of configurations that form a closed-loop with the steam source 14 may be used.

Additionally, the piping of the heat exchanger 20 may take on various profiles. According to one embodiment, the piping of the heat exchanger 20 may have a round cross-sectional profile. In other embodiments, the cross-section of the piping may include other shapes such as square, rectangular, etc. Please see FIGS. 3 and 4 for a heat exchanger 20' including a square profile.

The steam heat exchanger 20 may be made from various heat-conductive materials, such as metals. Metals such as copper, stainless steel, etc., have been found to be suitable for the heat exchanger 20. In certain embodiments, the heat exchanger 20 may be made from metal piping that may include fins or other types of surface texture for increasing the surface area, thus, water vaporization rates.

One type of piping that is suitable for the heat exchanger is a copper piping available from Wolverine Tube, Inc. under the model name Turbo-ELP®. The Turbo-ELP® copper piping available from Wolverine Tube, Inc. includes a unique surface texture on an outside surface of the piping. Integral helical fins on the outside surface of the tube are provided to enhance the initiation of nucleate boiling sites, thus improving the overall heat transfer coefficient of the pipe. The inside heat transfer coefficient is improved over smooth bore products because of increased surface area and turbulation induced by integral helical ridges on the inside surface of the piping. Through testing, the Turbo-ELP® piping has been found to improve water vaporization rates by up to 400% when compared to similar-thickness, smooth-surfaced copper pipes, over a wide range of boiler pressures. Please refer to the world-wide-web address "http://www.wlv.com/products/Enhanced/TurboELP.htm" for further information about Turbo-ELP® copper piping. Turbo-ELP® copper piping is also described in detail in U.S. Pat. No. 5,697,430, the entire disclosure of which is hereby incorporated by reference.

Other type of copper pipes, for example, copper pipes from Wolverine Tube, Inc. under the model names Turbo-CDI®, W/H Trufin, and H/F Trufin, may also be suitable for the heat exchanger of the present disclosure. Another pipe that may be suitable for the heat exchanger of the present disclosure is available from Wolverine Tube, Inc. under the model name MD (Micro Deformation). Other types of copper pipes, available from Wolverine Tube, Inc., described in U.S. Pat. Nos. 7,254,964 and 7,178,361 and in U.S. Patent Application Publication No. 2005/0126215, the entire disclosures of which are hereby incorporated by reference, are also suitable for use with the heat exchanger embodiments described in the present disclosure.

Still referring to FIG. 2, dispersed humidification steam condenses inside the steam dispersion tubes 18 when encountering cold air, for example, within a duct. Condensate 30 that forms within the dispersion tubes 18 drips down via gravity toward the heat exchanger 20 located at the bottom of the header 17. The condensate 30 contacts the exterior surface of the piping 24 of the heat exchanger 20 and is vaporized (i.e., reflashed back into the system). The energy required to turn the fallen condensate 30 back into steam creates condensate within the heat exchanger 20. The energy to vaporize the condensate comes from condensing an equivalent mass of steam within the heat exchanger 20. However, since the interior of the heat exchanger 20 is under a higher pressure, i.e., the pressure of the steam source 14, the condensate created therewithin is moved through the system 10 under this higher pressure, without the need for pumps or other devices.

In the depicted embodiment, the heat exchanger 20 is shown to span generally the entire length of the header so that it can contact condensate dripping from all of the tubes. In other embodiments, the heat exchanger 20 may span less than the entire length of the header (e.g., its length may be ½ of the header length or less).

In certain applications, the heat exchanger 20 may be kept supplied with pressurized steam even after humidification of the air through the tubes 18 is finished. By leaving the heat exchanger 20 on, standing condensate that has been formed at the bottom of the header 17, for example, can be removed via the pressure of the steam source 14. This can be accomplished in an automated manner via a control system controlling the supply of steam to the system 10. For example, a time delay between the shut-off time of the steam tubes 18 and the shut-off time of the heat exchanger 20 can be provided via the control system.

As discussed above, the heat exchanger 20 could be located at a different location than the interior of a header 17. The interior of the header 17 is one example location wherein condensate 30 forming within the steam dispersion system 10 may eventually end up. Other locations are certainly possible, so long as the steam within the heat exchanger 20 is at a higher pressure than atmospheric pressure and so long as the condensate forming within the heat exchanger 20 is able to contact the heat exchanger for piping through the system 10.

With the configuration of the steam dispersion system 10 of the present disclosure, short absorption distances are achieved and the resulting condensate may be moved efficiently through the system 10 without the use of pumps or other devices.

Figure 3:
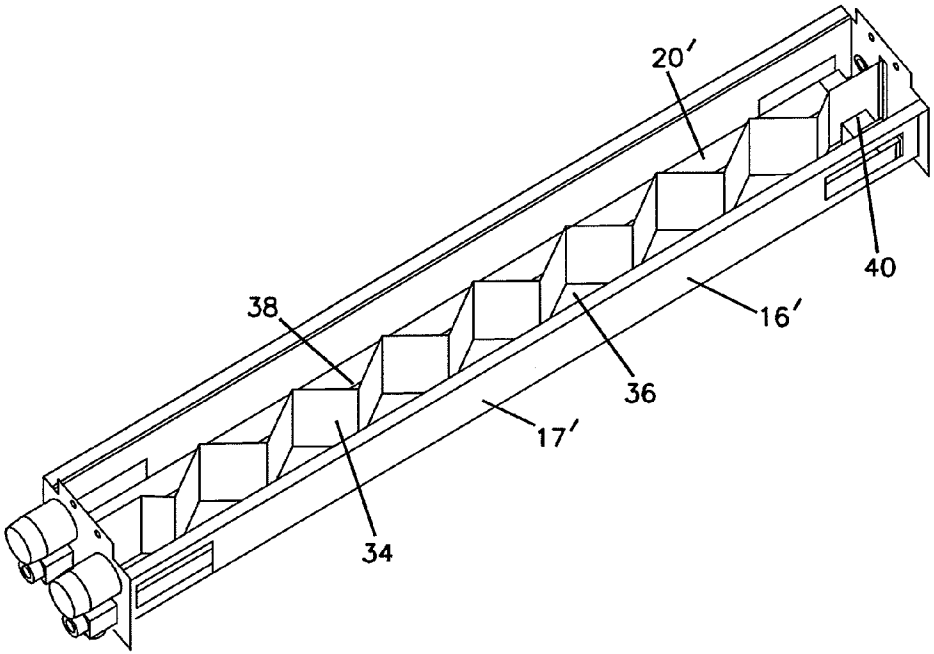
FIG. 3 illustrates a perspective view of a second embodiment of a steam manifold configured for use with the steam dispersion apparatus of FIG. 2.
Figure 4:
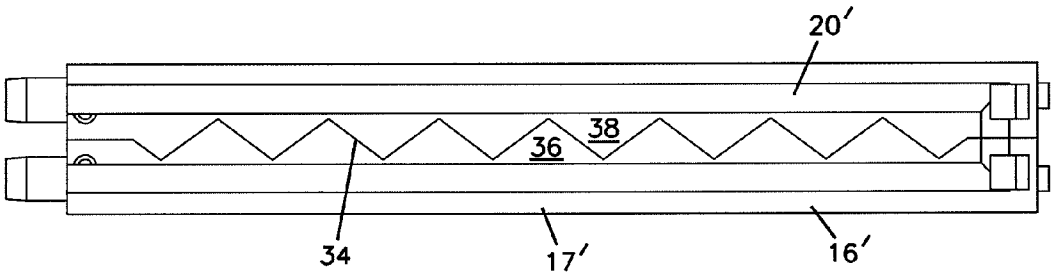
FIG. 4 illustrates a top view of the steam manifold of FIG. 3.
Figure 5:
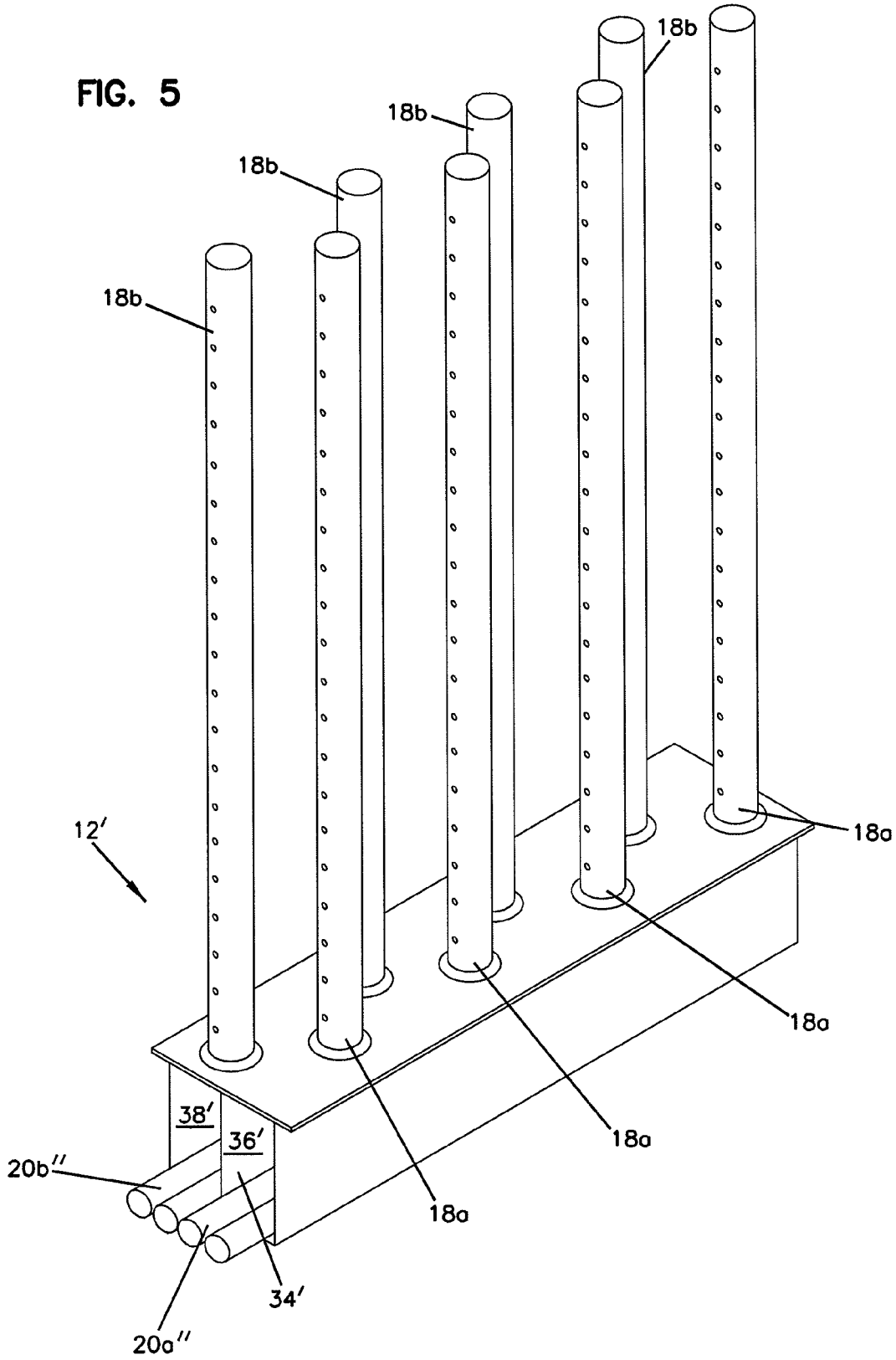
FIG. 5 illustrates a perspective of another embodiment of a steam dispersion apparatus configured for use with the steam dispersion system of FIG. 1.
Figure 6:
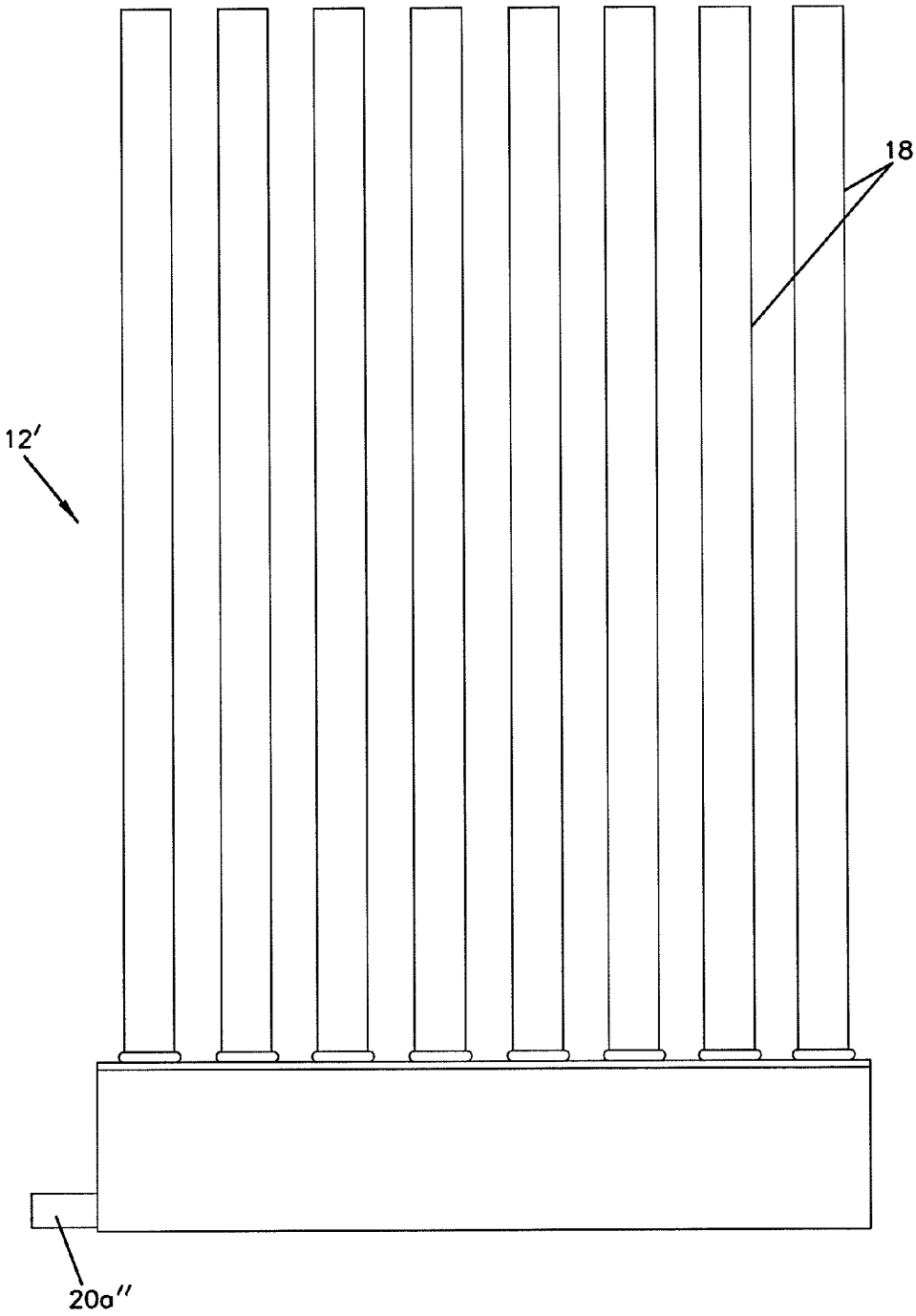
FIG. 6 illustrates a front view of the steam dispersion apparatus of FIG. 5.
Figure 7:
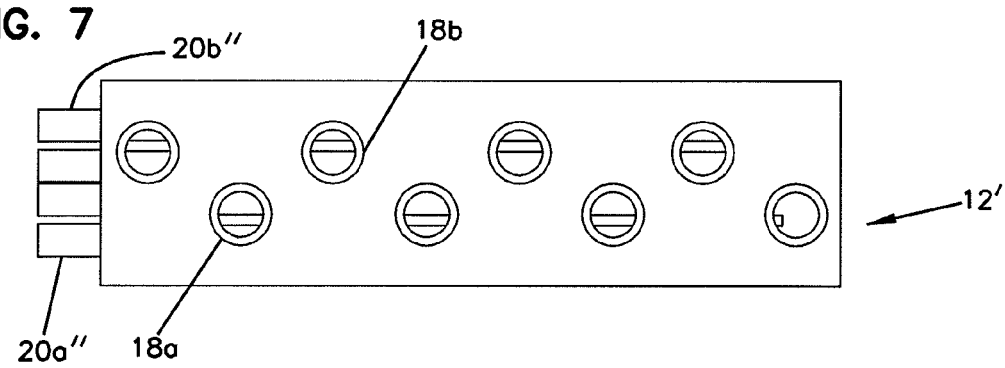
FIG. 7 illustrates a top view of the steam dispersion apparatus of FIG. 5.
Figure 8:
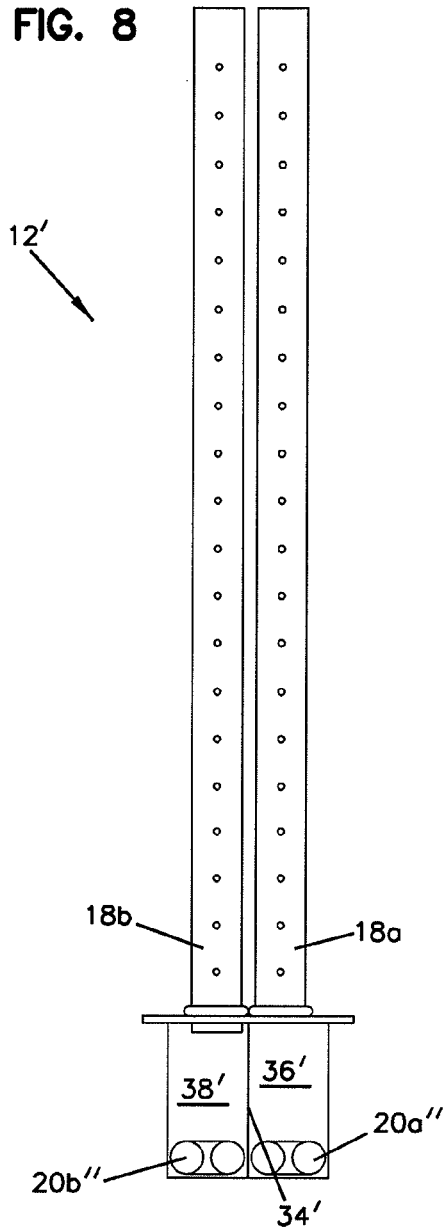
FIG. 8 illustrates a side view of the steam dispersion apparatus of FIG. 5.

FIGS. 3 and 4 illustrate another embodiment of a steam manifold 16' configured for use with the steam dispersion system 10 of FIG. 1. The steam manifold 16' is depicted as a header 17' that includes a divider 34 dividing the interior of the header 17' into two separate chambers 36, 38. The header 17' depicted is similar to the header described in FIGS. 1-14 of the commonly-owned U.S. application Ser. No. 11/804,991, entitled, "DEMAND ACTIVATED STEAM DISPERSION SYSTEM", the entire disclosure of which is hereby incorporated by reference. As described in U.S. application Ser. No. 11/804,991, the header 17' is divided into separate isolated chambers 36, 38 by the divider 34. The divider 34 is shaped such that, although all of the tubes 18 are arranged in a line along the center of the header 17', half of the steam dispersion tubes 18 communicates with one chamber 36, while the other half communicates with the other chamber 38. In such a system, a control system may be utilized to automatically activate or deactivate (i.e., supply or cut-off steam to) a given chamber 36, 38 in response to humidification demand, thus, using less than all of the tubes 18 when all are not needed.

As shown in FIGS. 3 and 4, although a single closed-loop pipe is used, effectively one half of the heat exchanger 20' is located within one chamber 36 and the other half is located within the other chamber 38. The divider 34 includes a cut-out 40 for accommodating the portion of the heat exchanger 20' that passes between the two isolated chambers 36, 38. The heat exchanger 20' shown in FIGS. 3 and 4 is depicted as including a square cross-section. As discussed above, other shapes are certainly possible.

FIGS. 5-8 illustrate another embodiment of a steam dispersion apparatus 12' configured for use with the steam dispersion system 10 of FIG. 1. The apparatus 12' illustrated in FIGS. 5-8 forms part of another version of a demand activated steam dispersion system in which less than all of the available tubes 18 may be used depending upon demand. The apparatus shown in FIGS. 5-8 forms part of a system that is similar to one illustrated in FIGS. 17-22 of U.S. application Ser. No. 11/804,991, the entire disclosure of which has been incorporated by reference.

The steam dispersion apparatus 12' shown in FIGS. 5-8 is similar in function to the system shown in FIGS. 3 and 4. However, in the system 12' illustrated in FIGS. 5-8, the steam dispersion tubes 18 are arranged in a zigzag arrangement, wherein the divider 34' includes a straight configuration. Half the tubes 18*a* communicates with one chamber 36' and the other half 18*b* communicates with the other chamber 38'. In the embodiment depicted in FIGS. 5-8, two heat exchangers 20*a*", 20*b*" are utilized, one in each chamber. Alternatively, as in the embodiment shown in FIGS. 3-4, a single heat exchanger can also be used, a portion of which passes through the divider 34'. In the embodiment depicted in FIGS. 5-8, the heat exchangers 20*a*", 20*b*" include round-profiled piping.

With the use of a heat exchanger as illustrated and described in the present disclosure, short absorption distances are achieved and the resulting condensate is moved efficiently through the system 10 without the use of pumps or other devices. In addition to improving the movement of condensate through the system 10, the amount of condensate 30 created in the overall system can be reduced by using insulation on the steam dispersion tubes 18 and/or other parts of the steam dispersion system 10, as described in commonly-owned U.S. application Ser. No. 11/521,083, entitled, "INSULATION FOR A STEAM CARRYING APPARATUS AND METHOD OF ATTACHMENT THEREOF", the entire disclosure of which is hereby incorporated by reference. As described in U.S. application Ser. No. 11/521,083, one type of insulation suitable for use with the systems illustrated and described herein is an insulation including a polyvinylidene fluoride fluoropolymer (PVDF). Since condensate can form on various parts of the steam dispersion system 10, such as the header 17, the steam dispersion tubes 18, etc., the insulation can be used on any portion (exterior or interior) of any steam carrying part (e.g., steam dispersion tubes, header, etc.) of the system 10, a number of examples of which have been illustrated in U.S. application Ser. No. 11/521,083.

As discussed in U.S. application Ser. No. 11/521,083, by using PVDF insulation around the steam dispersion tubes 18, the overall condensate in the system has been found to be reduced by about 45-60%. The condensate that forms can, then, be piped through the system 10 with the use of the heat exchanger 20.

If no insulation is used in the system 10, a similar overall condensate removal efficiency of the system 10 can still be achieved using higher steam source pressures.

As discussed previously, although in the illustrated examples, the steam source supplying humidification steam to the header 17 and pressurized steam to the heat exchanger are depicted as being the same source, it should be noted that two different sources may be used for supplying steam to the header 17 and to the heat exchanger. For example, the humidification steam source that supplies humidification steam to the header 17 may be generated by a boiler or an electric or gas humidifier and the steam source that provides pressurized steam to the heat exchanger may be a different boiler or other source supplying steam at a higher pressure than the humidification steam. Even though discussed herein as using pressurized steam to reflash the condensate back into the system, it should be noted that the heat exchanger may use other sources of energy to reflash condensate back into the dispersion system. For example, in other embodiments, an energy source other than pressurized steam, such as electricity or gas may be used. Electric heating elements or gas burners may be used for the heat exchanger.

Figure 9:
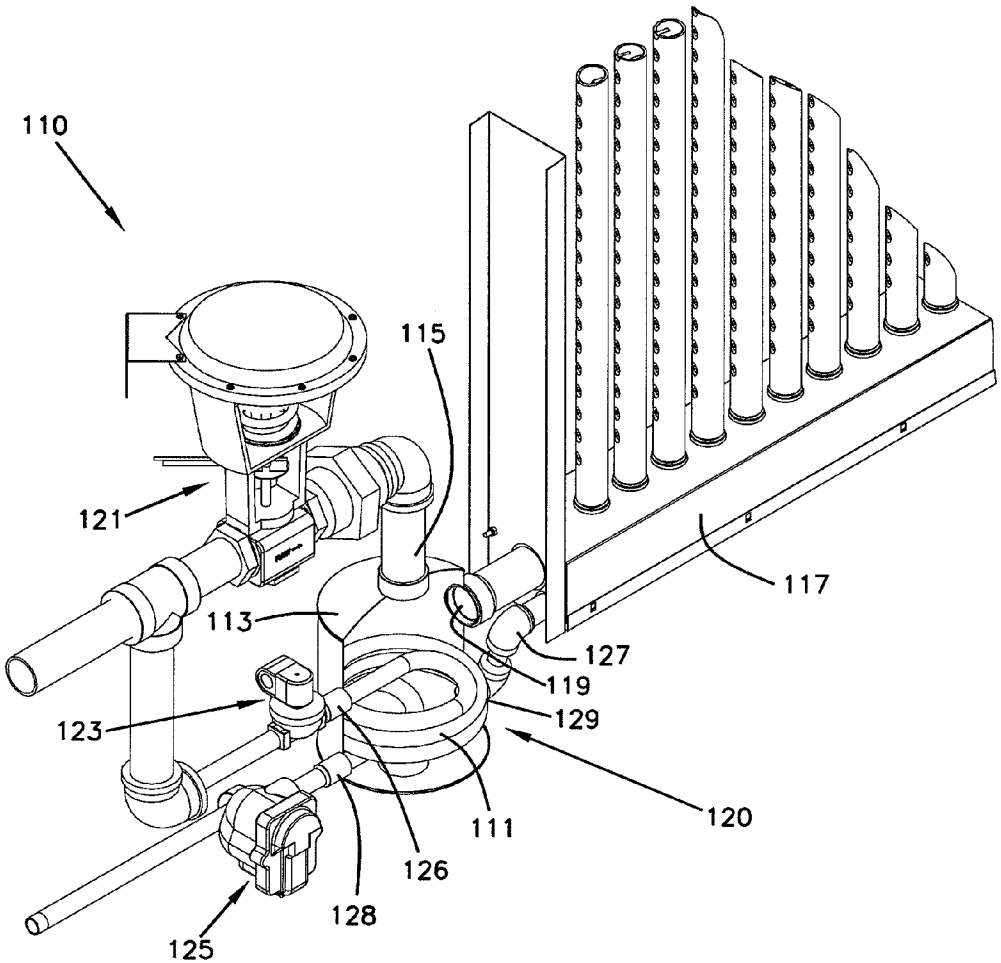
FIG. 9 illustrates a perspective view of another steam dispersion system having features that are examples of inventive aspects in accordance with the principles of the present disclosure, portions of the steam dispersion system broken away to illustrate the internal features thereof.
Figure 10:
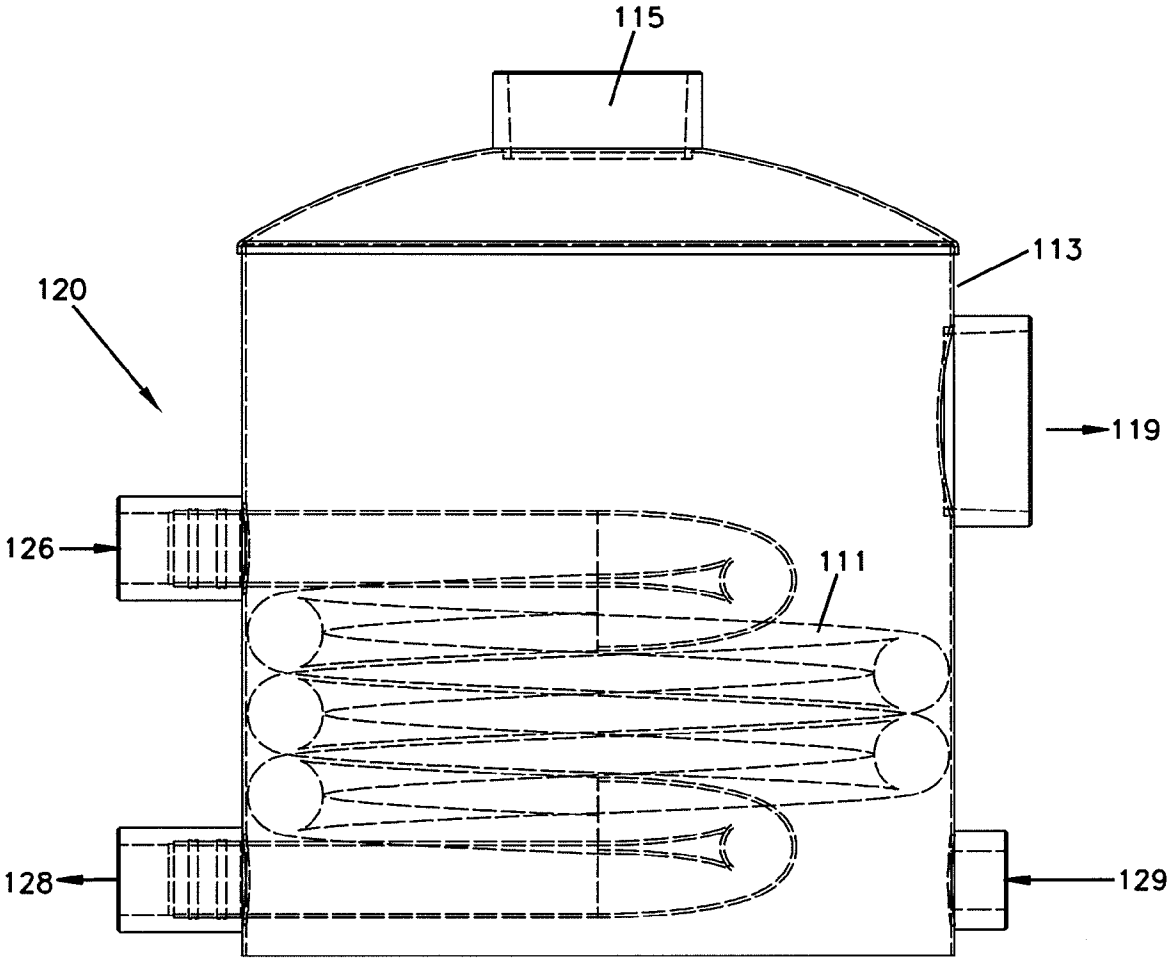
FIG. 10 illustrates a diagrammatic view of a heat exchanger configured for use with the steam dispersion system of FIG. 9.

Referring to FIGS. 9-10, another embodiment of a steam dispersion system 110 having features that are examples of inventive aspects in accordance with the principles of the present disclosure is illustrated. As discussed above, a heat exchanger 120 may be located at a location that is remote from the central steam chamber (e.g., a header 117) and not positioned within the central steam chamber. Such a system is shown in FIGS. 9-10. In this type of a system, the heat exchanger 120 is remote from, however, in fluid communication with the header 117 so as to make contact with the condensate within the header 117. In this manner, condensate may still be pumped away without the use of pumps or other devices.

Referring to FIGS. 9-10, the heat exchanger 120 is provided in the form of a coil 111 within a housing 113. Portions of the housing 113 have been broken away to illustrate the coil 111 therewithin. The housing 113 is mounted outside of the central steam chamber. The housing 113 includes a humidification steam inlet 115 for receiving steam from a steam source, such as a boiler. The housing 113 includes a humidification steam outlet 119 that is in fluid communication with the central steam chamber (e.g., the header 117) for forwarding the humidification steam to the central steam chamber. In other embodiments, the humidification steam may directly enter the central steam chamber rather than go through the housing 113 first. As depicted, a modulating steam valve 121 may be provided for controlling the inlet of humidification steam into the housing/central steam chamber.

For reflashing condensate back into the dispersion system 110, the heat exchanger 120 forms a closed-loop arrangement with a pressurized steam source such as the boiler. The heat exchanger 120 includes a pressurized steam inlet 126 and a pressurized condensate outlet 128.

As depicted, a solenoid valve 123 may be used to control the inlet of pressurized steam into the heat exchanger 120 and a trap 125 (e.g., a float and thermostatic trap, as depicted) may be used to control the outlet of condensate from the heat exchanger 120. By using a trap 125, pressurized steam within the heat exchanger 120 can be prevented from being poured out, with only condensate being let out.

It should be noted that, in other embodiments, the remote heat exchanger could use electricity or gas instead of pressurized steam for reflashing condensate back into the dispersion system.

The housing 113 is also in fluid communication with the header 117 via a condensate pipe 127. Condensate from the header 117 can enter the housing 113 through a condensate inlet 129, contact the heat exchanger coil 111, and be vaporized into steam by the heat exchanger 120. The vaporized steam is, then, returned back to the central steam chamber through the humidification steam outlet 119 of the housing 113.

The housing 113 is positioned such that condensate from the central steam chamber can flow into the housing 113 via gravity and returned back to the central chamber after being vaporized. Pressurized condensate which forms within the coil 111 as a result of reflashing the condensate at the bottom of the housing 113 can then exit the heat exchanger 120 and return to the boiler under pressure.

With the steam dispersion systems 10, 110 described herein, approximately 100% of the humidification steam that enters the systems can eventually enter the space to be humidified. As such, additional condensate return lines may be reduced or totally eliminated.

The above specification, examples and data provide a complete description of the inventive features of the disclosure. Many embodiments of the disclosure can be made without departing from the spirit and scope thereof

The invention claimed is:

1. A steam dispersion system comprising:

a manifold including a header and a plurality of steam dispersion tubes, the header having a header interior, the steam dispersion tubes being mounted to a top side of the header and being oriented to project upwardly from the top side of the header, the steam dispersion tubes having tube interiors in fluid communication with the header interior, the steam dispersion tubes defining steam dispersion openings in fluid communication with the tube interiors, wherein the steam dispersion system is configured such that humidification steam flows through the header interior to the tube interiors and exits the manifold through the steam dispersion openings; and a heat exchanger positioned within the header interior, the heat exchanger including a heat exchanger interior and a heat exchanger exterior, the steam dispersion system being configured to operate with the heat exchanger interior at a higher pressure than the header interior, and the steam dispersion system being configured such that humidification steam that condenses within an interior of the manifold is re-evaporated into humidification steam within the header interior by heat transferred outwardly from the heat exchanger.

2. The steam dispersion system of claim 1, wherein the steam dispersion tubes extend vertically upwardly from the header.

3. The steam dispersion system of claim 1, wherein the heat exchanger is mounted at a bottom of the header.

4. The steam dispersion system of claim 1, wherein the heat exchanger is U-shaped.

5. The steam dispersion system of claim 1, wherein the header is elongated along a length that extends between first and second ends of the header, wherein the heat exchanger has an inlet and an outlet that are both located at the first end of the header.

6. The steam dispersion system of claim 5, wherein the heat exchanger includes a flow-turning section positioned adjacent the second end of the header, wherein the heat exchanger includes a first segment that extends from the inlet to the flow-turning section and a second segment that extends from the flow-turning section to the outlet.

7. The steam dispersion system of claim 6, wherein the first and second segments are parallel and the flow-turning section provides a 180 degree turn.

8. The steam dispersion system of claim 1, wherein condensation formed within the manifold is re-evaporated upon contact with the heat exchanger exterior.

9. The steam dispersion system of claim 1, wherein the pressure in the heat exchanger interior is in the range of 2-60 psi.

10. The steam dispersion system of claim 9, wherein the pressure in the header interior is about atmospheric pressure.

11. The steam dispersion system of claim 1, further comprising a steam generation arrangement, wherein steam generated by the steam generation arrangement is directed into the heat exchanger interior to heat the heat exchanger, and wherein steam generated by the steam generation arrangement is directed into the header interior as humidification steam.

12. The steam dispersion system of claim 11, wherein at least some of the steam directed into the heat exchanger interior is returned to the steam generation arrangement as condensate.

13. The steam dispersion system of claim 12, wherein the steam generation arrangement includes a single boiler.

14. The steam dispersion system of claim 12, wherein the steam generation arrangement includes multiple distinct steam generators.

15. The steam dispersion system of claim 1, further comprising a boiler, wherein steam generated by the boiler is directed into the heat exchanger interior to heat the heat exchanger, and wherein steam generated by the boiler is directed into the header interior as humidification steam, wherein at least some of the steam directed into the heat exchanger interior is returned to the boiler as condensate.

* * * * *